US008126116B2

(12) United States Patent
Bathe

(10) Patent No.: US 8,126,116 B2
(45) Date of Patent: Feb. 28, 2012

(54) ANODE PLATE FOR X-RAY TUBE AND METHOD OF MANUFACTURE

(75) Inventor: Christoph Bathe, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/299,132

(22) PCT Filed: Apr. 26, 2007

(86) PCT No.: PCT/IB2007/051559

§ 371 (c)(1),
(2), (4) Date: Oct. 31, 2008

(87) PCT Pub. No.: WO2007/129248

PCT Pub. Date: Nov. 15, 2007

(65) Prior Publication Data

US 2009/0086916 A1 Apr. 2, 2009

(30) Foreign Application Priority Data

May 5, 2006 (EP) ..... 06113548

(51) Int. Cl.
*H01J 35/10* (2006.01)
*H01J 35/00* (2006.01)

(52) U.S. Cl. ..... 378/125; 378/144

(58) Field of Classification Search ..... 378/119, 378/121, 125–128, 143, 144
See application file for complete search history.

(56) References Cited

U.S. PATENT DOCUMENTS

| | | | | |
|---|---|---|---|---|
| 2,071,696 | A * | 2/1937 | Jonas | 378/127 |
| 3,751,702 | A * | 8/1973 | Dietz | 378/125 |
| 3,836,804 | A | 9/1974 | Frens et al. | |
| 4,531,227 | A * | 7/1985 | Fukuhara et al. | 378/144 |
| 4,991,194 | A * | 2/1991 | Laurent et al. | 378/144 |
| 5,277,496 | A * | 1/1994 | Mayer et al. | 374/130 |
| 5,461,659 | A * | 10/1995 | Siemers et al. | 378/129 |
| 5,530,733 | A * | 6/1996 | Eggleston et al. | 378/125 |
| 5,681,616 | A * | 10/1997 | Gupta et al. | 427/264 |
| 6,212,753 | B1 * | 4/2001 | Derakhshan et al. | 29/447 |
| 2003/0207079 | A1 * | 11/2003 | Subramanian | 428/136 |

FOREIGN PATENT DOCUMENTS

| | | |
|---|---|---|
| DE | 687378 | 1/1940 |
| DE | 3107924 A1 | 9/1982 |
| JP | 2003239871 A | 8/2003 |

* cited by examiner

*Primary Examiner* — Anastasia Midkiff

(57) ABSTRACT

An anode plate for an X-ray tube includes an outer edge, a center region, and a plurality of slots disposed along the outer edge and extending toward the center region (210*b*) with each of the plurality of slots including a slot end. The anode plate further includes slot termination material disposed around a least a portion of the periphery of one or more of the slot ends, the slot termination material operable to reduce the tension stress or compression stress at the slot end.

29 Claims, 5 Drawing Sheets

ANODE PLATE FOR X-RAY TUBE AND METHOD OF MANUFACTURE

The present invention relates to x-ray tubes, and to anode plates employed in X-ray tubes and their corresponding method of manufacture.

An anode plate (typically in the form of a rotating disk) is implemented in an X-ray tube used in diagnostic medical equipment, such as computed tomography (CT) systems. Under normal operating conditions, the anode plate is subjected to large mechanical compression and tensile stresses resulting from the anode's high rotational speed, as well as extreme thermal loading resulting from heat generated from an incident electron beam impinging the anode's surface. These mechanical and thermal stresses degrade the anode surface, leading to, for example, cracking or warping of the anode plate over time. The usable lifetime of the anode, and accordingly, the X-ray tube, is reduced by these effects.

FIG. 1A illustrates a top view of one conventional rotating anode plate 100 showing thermal gradient and tangential stress distribution. The outer diameter 110 represents the target area in which an electron beam strikes the anode plate 100. About 99% of the kinetic energy of the incident electron bean is transferred into heat, forming a thermal gradient between the outer and inner diameters 110 and 130. Due to the thermal expansion coefficient, mechanical compression stress in the tangential direction is generated at the outer diameter while tensile stress in the tangential direction is generated at the inner diameter.

FIGS. 1B and 1C illustrate a conventional anode plate design in which radial slots 140 are used to reduce the aforementioned tensile and compression stresses. In particular, the radial slots 140 extend from the anode's outer edge toward the inner region 130, the radial slots 140 having rounded slot ends 142 for further reducing mechanical stresses on the anode 100. FIG. 1B further illustrates the tangential stress distribution across the anode plate during rotation and thermal loading. As can be seen therefrom, the radial slots 140 operate to reduce the stresses at the outer edge of the anode plate, but high compression stress is exhibited at the slot ends 142. FIG. 1C illustrates the tangential stress distribution across the anode plate during anode rotation without thermal loading, which shows a high degree of tensile stress is imparted to the slot end 142.

It may be desirable to provide an anode plate with reduced tensile and compression stresses, so as to extend the usable lifetime of the X-ray tube in which the anode plate is used.

This need may be met by an anode plate for an X-ray tube according to the independent claims.

In one embodiment of the invention, an anode plate for an X-ray tube is provided and includes slots disposed along the outer edge and extending toward the center region, each of the slots terminating in a slot end. The anode plate further includes slot termination material disposed around at least a portion of the periphery of one or more of the slot ends. The slot termination material is operable to reduce the tension stress or compression stress which may be developed at the slot end as a result of the rotation and/or heating of the anode as described above.

In another embodiment of the invention, a method for manufacturing an anode plate for an X-ray tube includes the operation forming the anode plate having an outer edge and a center region, the anode plate including a plurality of slots disposed along the outer edge and extending toward the center region, each of the plurality of slots including a slot end, the manufacturing method further includes depositing slot termination material around at least a portion of the periphery of one or more of the slot ends, the slot termination material operable to reduce the tension stress or compression stress at the slot end.

In a further embodiment of the invention, an X-ray tube is presented having a cathode operable to provide a stream of electrons for bombarding an anode, and an anode plate in accordance with the present invention.

It may be seen as a gist of an exemplary embodiment of the present invention that slot termination material is deposited at the slot ends to reduce the compression and tensile stress developed at the slot ends during operation, thus extending the usable lifetime of the anode plate, and accordingly, the X-ray tube in which it is employed.

The following describes exemplary features and refinements of the anode of an X-ray tube in accordance with the invention, although these features and refinements will apply to the manufacturing system as well.

In optional embodiments, the anode plate and the slot ends may be of a generally circular shape. Further exemplary, the slot termination material (230) is disposed around at least one-half of the periphery of the slot end, and further optionally around substantially the entire periphery of the slot end. As a further exemplary embodiment, the slot termination material may be formed within an inner ring of the anode plate, whereby the slot ends of one or more slots intersects the inner ring of slot termination material. Exemplary embodiments of the slot termination material may be selected from a group of ductile refractory metals consisting of Ti, V, Ta, Nb, Re and alloys thereof. Further optionally, the slot termination material may be formed from Ni-based super alloy, fiber reinforced materials or materials with high fracture toughness.

The following describes exemplary features and refinements of a method of manufacturing the X-ray tube anode in accordance with the invention, although these features and refinements may also apply to the aforementioned manufacturing method.

In one embodiment of the manufacturing method, the anode plate and the slot ends may be formed in a generally circular shape. Further exemplary, the slot termination material is optionally deposited around at least one-half of the periphery of one or more of the slot ends. In a further optional embodiment, slot termination material is deposited on the anode plate in the form of an inner ring, whereby the slot end of one or more of the slots intersect the inner ring of slot termination material. In another optional embodiment, a first hole is provided in the anode plate at a location in which a slot end is intended. Next, slot termination material is deposited within the first hole. Next, a second hole within the deposited slot termination material is provided, the second hole forming a slot end. Next, a slot is extended from the slot end to the outer edge of the anode plate. The slot termination material may be composed of ductile refractory metals consisting of Ti, V, Ta, Nb, Re and alloys thereof, or a Ni-based super alloy.

The operations of the foregoing methods may be realized by a computer program, i.e. by software, or by using one or more special electronic optimization circuits, i.e. in hardware, or in hybrid/firmware form, i.e. by software components and hardware components. The computer program may be implemented as computer readable instruction code in any suitable programming language, such as, for example, JAVA, C++, and may be stored on a computer-readable medium (removable disk, volatile or non-volatile memory, embedded memory/processor, etc.), the instruction code operable to program a computer of other such programmable device to carry out the intended functions. The computer program may be available from a network, such as the WorldWideWeb, from which it may be downloaded.

These and other aspects of the present invention will become apparent from and elucidated with reference to the embodiment described hereinafter.

An exemplary embodiment of the present invention will be described in the following, with reference to the following drawings.

Figure 1A:
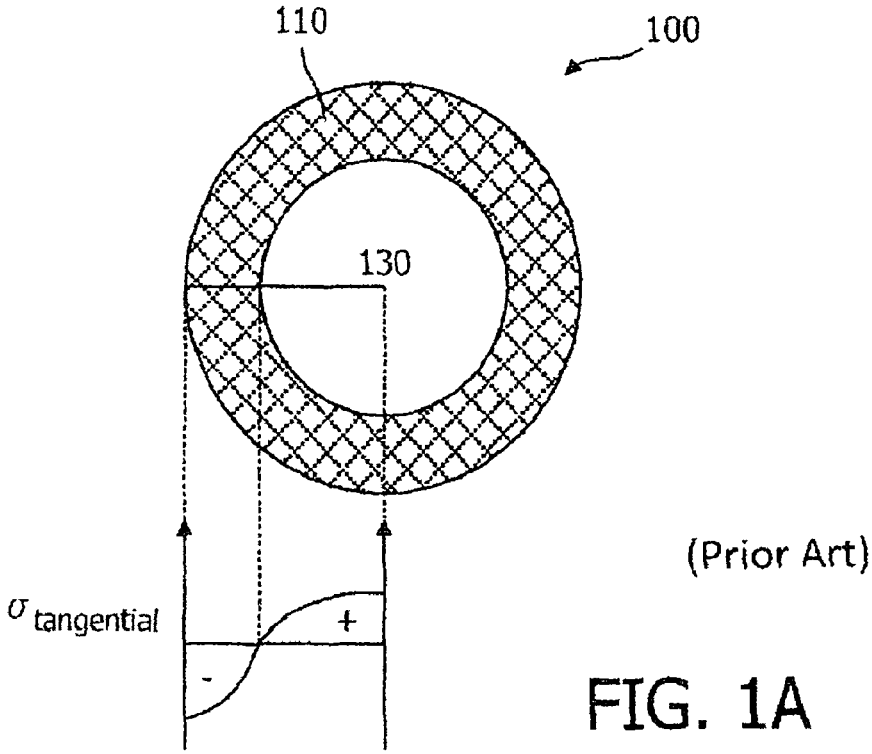
FIGS. 1A-1C illustrates top views of a conventional anode plate for an X-ray tube and corresponding showing thermal gradient and tangential stress distribution thereacross.
Figure 1B:
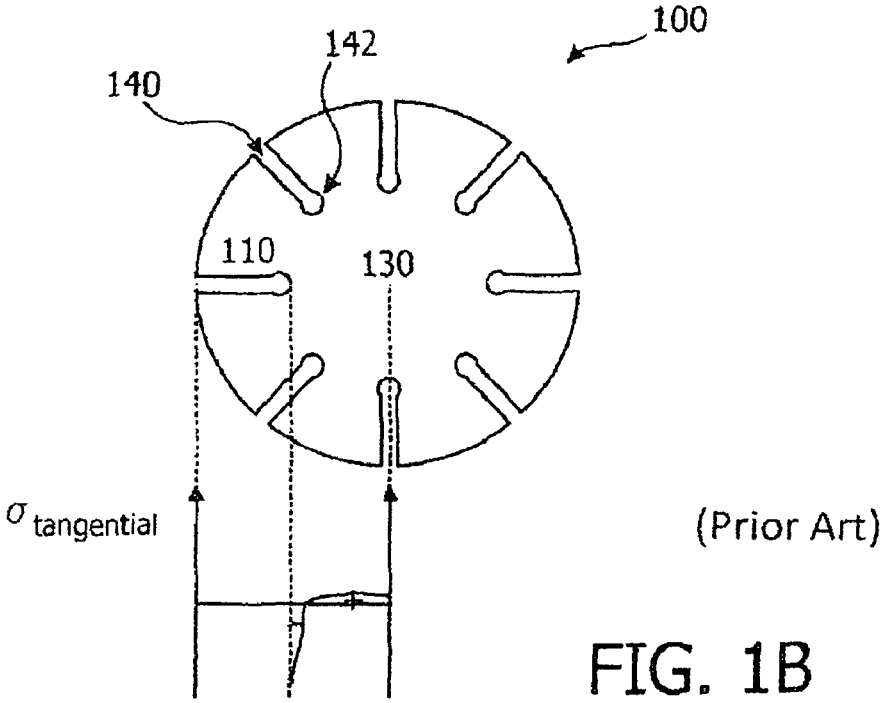
Figure 1C:
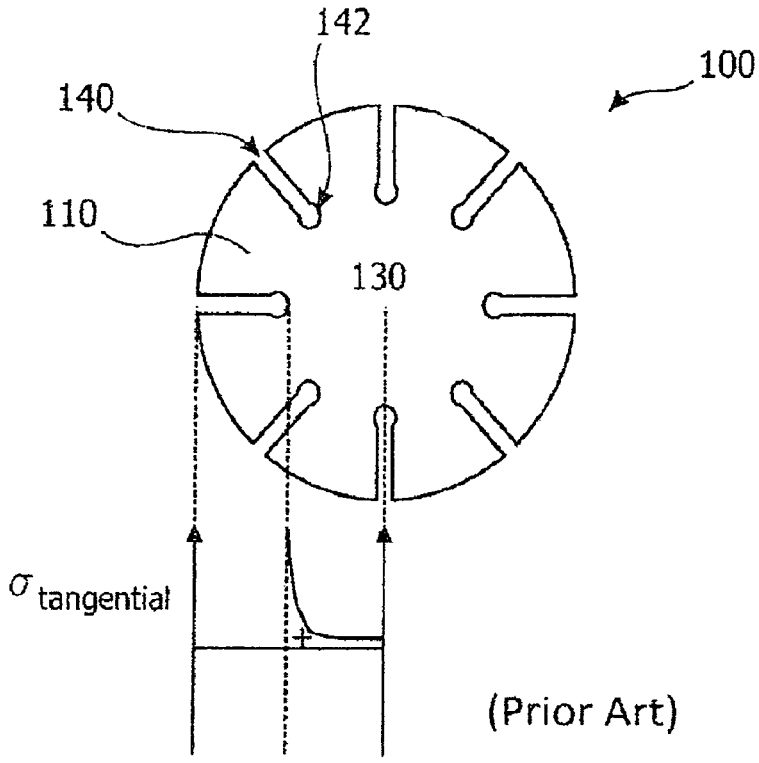

For clarity, previously-identified features retain their reference numerals in subsequent drawings.

Figure 2A:
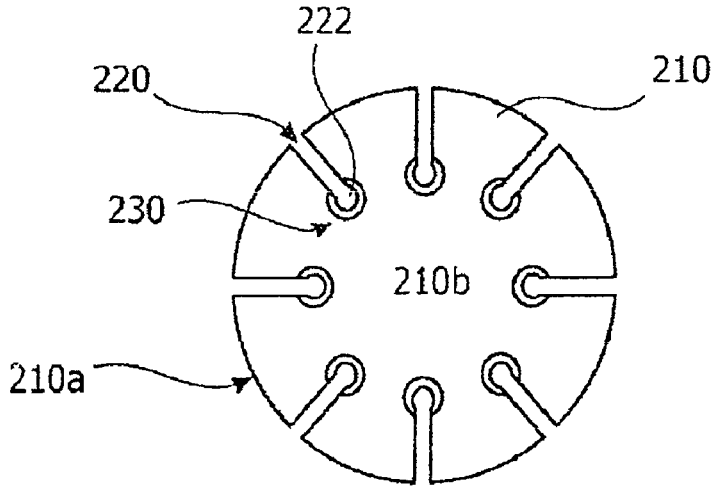
FIG. 2A illustrates a first exemplary embodiment of an anode plate for an X-ray tube in accordance with the present invention.

FIG. 2A illustrates a first exemplary embodiment of an anode plate for an X-ray tube in accordance with the present invention. The anode plate 210 includes slots 220 disposed along the outer edge 210*a* and extending toward the center region 210*b*, each of the slots 220 terminating in a slot end 222. The anode plate 210 further includes slot termination material 230 disposed around at least a portion of the periphery of one or more of the slot ends 222. The slot termination material 230 is operable to reduce the tension stress or compression stress which may be developed at the slot end 222 as a result of the rotation and/or heating of the anode as described above.

In a particular embodiment of the invention, the anode plate 210 is generally circular shape, although other shapes may be alternatively employed. Further exemplary, the slot ends 222 may be of a generally circular shape, although different geometry may be implemented as well in other embodiments under the invention.

The slot termination material 230 is disposed at least partially around the periphery of one or more of the slot ends 222. In one embodiment, the slot termination material 230 extends at least half way around the periphery of one or more of the slot ends 222, and in another embodiment, the slot termination material extends substantially around the entire slot end periphery, as shown in FIG. 2A. The term "slot end periphery" refers to the periphery of the slot end 222 around which a portion of the anode plate is located, excluding the slot 220 itself. The anode plate 210 may be constructed from conventional materials such as Mo-alloys. The slot termination material 230 may be ductile refractory metals such as Ti, V, Ta, Nb, Re, or alloys thereof. Alternatively, Ni-based super alloy may be used for the slot termination material 230. Further exemplary, materials which exhibit high ductility, high fracture toughness, and low Young's modulus or fiber reinforced materials may be employed as the slot termination material 230.

Figure 2B:
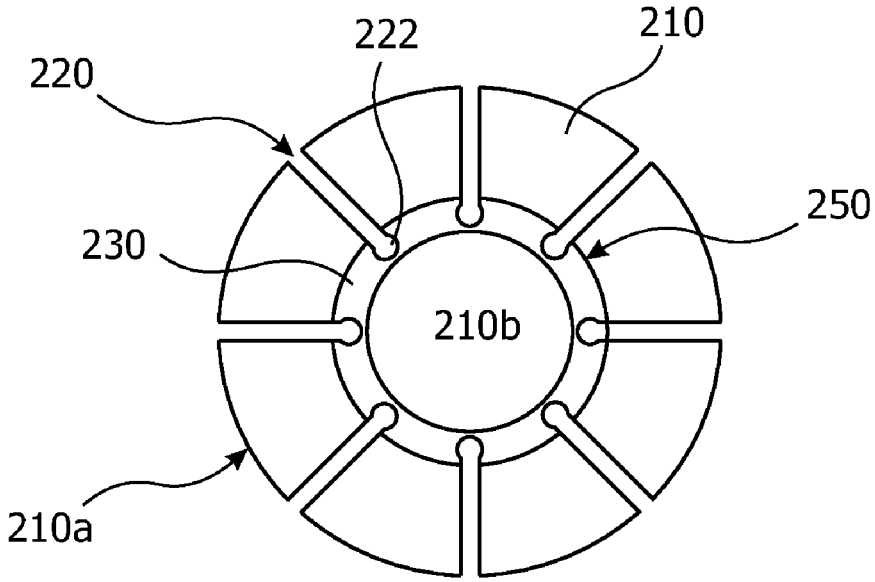
FIG. 2B illustrates a second exemplary embodiment of an anode plate for an X-ray tube in accordance with the present invention.

FIG. 2B illustrates a second exemplary embodiment of an anode plate for an X-ray tube in accordance with the present invention, with previously recited feature retaining their reference numerals. In this embodiment, the anode plate 210 includes an inner ring 250 of slot termination material 230, whereby the slot end 222 of one or more of the slots intersects the inner ring 250 of slot termination material 230. In the particular embodiment shown, the slot termination material 230 extends around the entire periphery of the slot end 222. In alternative embodiments, the positioning and/or width of the inner ring 250 is such that less than the entire periphery of the slot end 222 is covered, for example, half of the periphery, one quarter of the periphery, or less. Exemplary slot and hole dimensions for a generally circular anode plate of radius R would be as follows: width of slot 220: 0.001*R to 0.02*R; length of slot 220: 0.2-0.8*R; radius of slot end 222: less than 0.02*R; radius of slot termination material 230 disposed around at least a part of the slot end 222: 0.005 to 0.2*R; width of the inner ring of slot termination material (250, when employed) 0.005 to 0.2*R.

Figure 3:
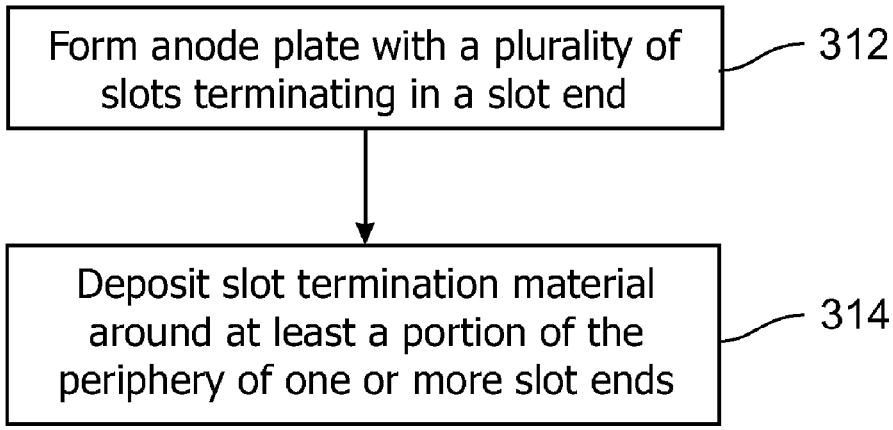
FIG. 3 illustrates an exemplary embodiment for manufacturing an anode plate for an X-ray tube in accordance with the invention.

FIG. 3 illustrates an exemplary embodiment for manufacturing an anode plate for an X-ray tube in accordance with the invention. Initially at 312, an anode plate 210 is formed having a plurality of slots (220) extending from an outer edge 210*a* of the anode plate toward a center region 210*b*. In an exemplary embodiment, the anode plate is formed in a generally circular shape, although other shapes may be used in accordance with the present invention. Further exemplary, the slot ends 222 are formed in a generally circular shape, although other shapes may be used in accordance with the present invention.

Next at 314, slot termination material 230 is deposited around at least a portion of the periphery of one of one or more of the slot ends 220, the slot termination material 230 operable to reduce the tension stress or compression stress at the one or more slot ends 222. In a particular embodiment of this process, slot termination material is deposited around the periphery of each of the slot ends 222, although in other embodiments, one or more slot ends may exclude the slot termination material. Further exemplary, the slot termination material 230 may be deposited around at least one half of the periphery of one or more of the slot ends 222, e.g., extending around substantially the entire periphery of the slot ends 222, as illustrated in FIGS. 2A and 2B. Of course, other embodiments are also possible, for example, the slot termination material may extend around less than half of the periphery of the slot ends 222, e.g., one quarter of the slot end periphery.

In a first specific process of 314, an inner ring of slot termination material 250 is formed on the anode plate, whereby one or more slot ends 222 intersects the inner ring 250. The inner ring of slot termination material 250 may be deposited using, e.g. power metallurgy, plasma spraying, or such similar techniques known in the art.

Figure 4A:
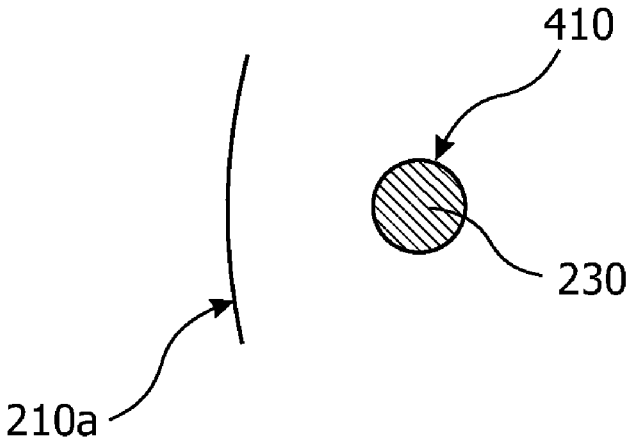
FIGS. 4A-4B illustrate exemplary processes by which an inner ring of slot termination material is formed on the anode plate for an X-ray tube in accordance with the invention.
Figure 4B:
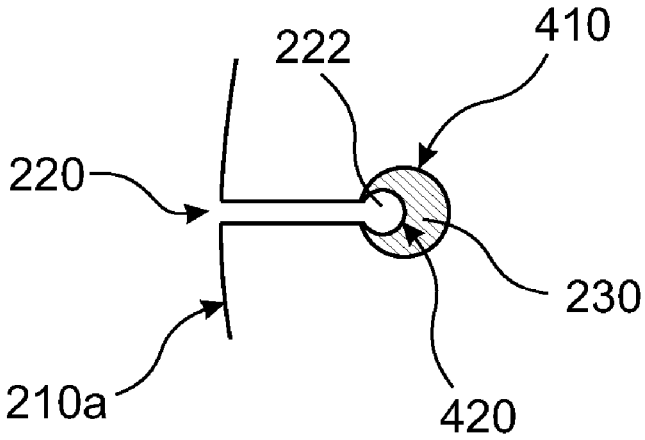

FIGS. 4A-4B illustrate a second specific process of 314 in which slot termination material 230 is formed around at least a portion of the periphery of a slot end 222. Initially, a first hole 410 is provided (e.g., drilled, etched, machined, or the like) in the anode plate 210 at a location in which the slot end is intended. Next, the first hole 410 is filled with the slot termination material 230. Further exemplary a bolt made from slot termination material 230 is put into hole 410 and connected to plate 210 by e.g. brazing. FIG. 4A illustrates the resulting structure.

Next, a second hole 420 is provided within the slot termination material 230, the second hole 420 forming a slot end 222. Subsequently, a slot 220 is extended (e.g., by drilling, etching, machining, or the like.) from the slot end 222/420 to the outer edge 210*a* of the anode plate. FIG. 4B illustrates the resulting structure.

Figure 5:
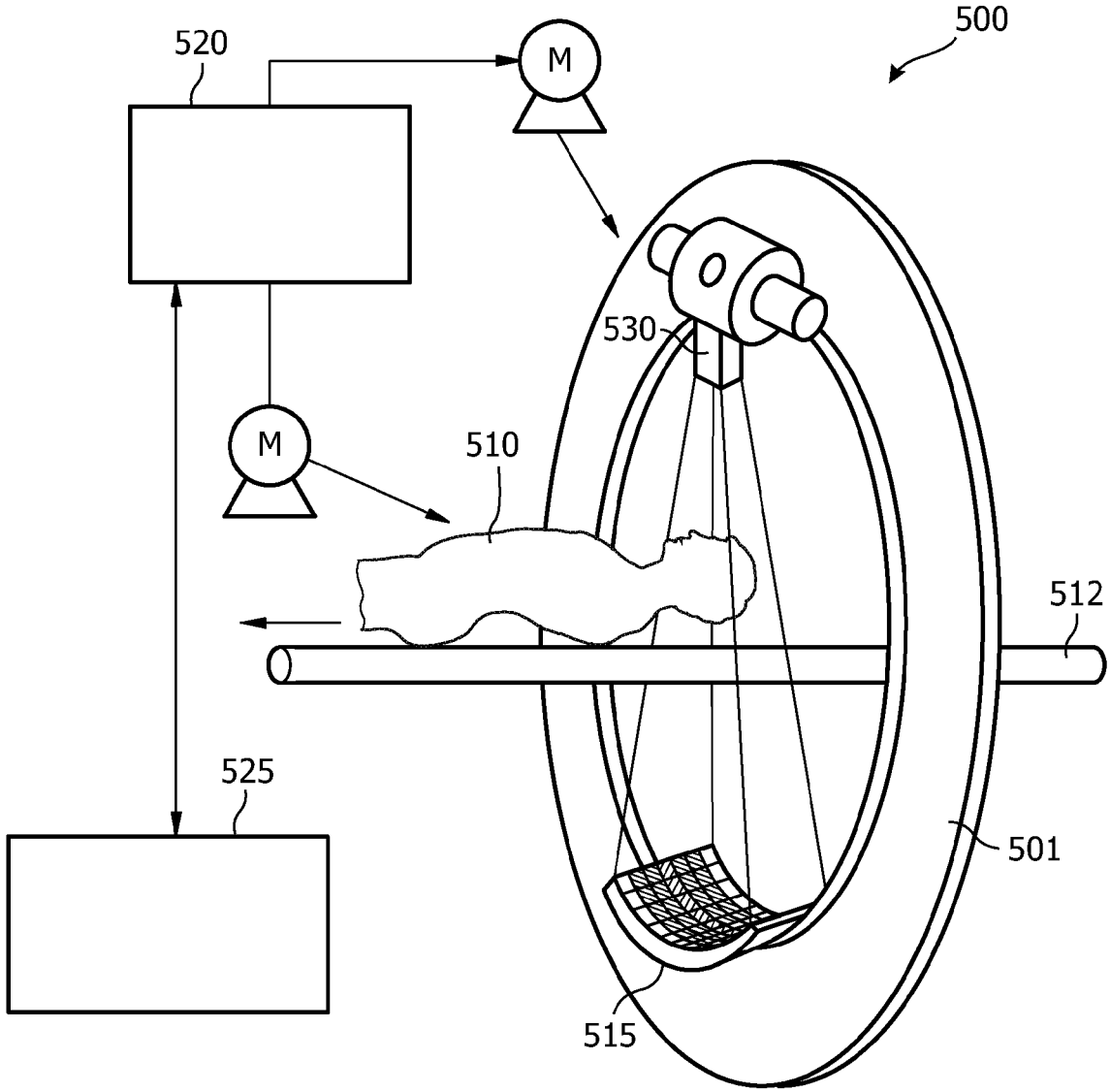
FIG. 5 illustrate a computed tomography system having an X-ray tube employing an anode plate in accordance with the present invention.

FIG. 5 illustrate a computed tomography (CT) system (cone beam) having an X-ray tube 530 employing an anode plate in accordance with the present invention. The CT system 500 includes a gantry 501, within which a X-ray tube 530 and an opposing detector 515 rotate to provide x-ray images of a patient 510 or object positioned therebetween. Within the X-ray tube 530, a cathode is operable to generate a steam of electrons for bombarding an anode plate, the anode plate in response emitting X-rays through an X-ray transparent material/window for illuminating the patient 510 or object. Motor control units 520 and 525 control movement of the X-ray tube 530 and the patient platform 512. As noted above, the anode's high rotational speed and surface heat produces significant compression and tension stresses on the anode. The present invention provides an anode plate having decreased compression and tension stresses, thus extending the usable lifetime of the X-ray tube, and in turn enabling less maintenance, and greater reliability of the CT system.

In summary, it may be seen as one aspect of the present invention that a slotted anode plate for an X-ray tube is presented which is operable with decreased compression and tension stress forces on the slot ends. The anode includes a plurality of slots extending from the plate's outer edge toward the center region, each of the slots including a slot end. Slot termination material is disposed on the slot ends, the slot termination material operable to reduce the tension stress or compression stress at the slot end.

As readily appreciated by those skilled in the art, the described processes may be implemented in hardware, software, firmware or a combination of these implementations as appropriate. In addition, some or all of the described processes may be implemented as computer readable instruction code resident on a computer readable medium (removable disk, volatile or non-volatile memory, embedded processors, etc.), the instruction code operable to program a computer of other such programmable device to carry out the intended functions.

It should be noted that the term "comprising" does not exclude other features, and the definite article "a" or "an" does not exclude a plurality, except when indicated. It is to be further noted that elements described in association with different embodiments may be combined. It is also noted that reference signs in the claims shall not be construed as limiting the scope of the claims.

The foregoing description has been presented for purposes of illustration and description. It is not intended to be exhaustive or to limit the invention to the precise form disclosed, and obviously many modifications and variations are possible in light of the disclosed teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

The invention claimed is:

1. An anode plate for an X-ray tube, the anode plate having an outer edge, a center region, and a plurality of slots disposed along the outer edge and extending toward the center region, each of the plurality of slots including a slot end, the anode plate comprising:

slot termination material, at least some of which is disposed around at least a portion of the periphery of one or more of the slot ends, the slot termination material operable to reduce the tension stress or compression stress at the slot end.

2. The anode plate of claim 1, wherein the slot termination material is disposed around at least one-half of the periphery of one or more of the slot ends.

3. The anode plate of claim 1, wherein the slot termination material is disposed around substantially the entire periphery of one or more of the slot ends.

4. The anode plate of claim 1, wherein said material is formed between inner and outer radii of an inner ring at, and intersecting with, the slot end of one or more of the slots, said ring being concentric with said plate.

5. The anode plate of claim 1, wherein the slot termination material is selected from a group of ductile refractory metals consisting of Ti, V, Ta, Nb, Re and alloys thereof.

6. The anode plate of claim 1, wherein the slot termination material comprises a Ni-based super alloy.

7. An X-ray tube for a CT system, comprising:

a cathode; and an anode as claimed in claim 1.

8. The X-ray tube of claim 7, wherein the slot termination material is disposed around at least one-half of the periphery of one or more of the slot ends.

9. The X-ray tube of claim 7, wherein the slot termination material is disposed around substantially the entire periphery of one or more of the slot ends.

10. The X-ray tube of claim 7, wherein the slot termination material is formed between inner and outer radii of an inner ring at, and intersecting with, the slot end of one or more of the slots, said ring being concentric with said plate.

11. A method for manufacturing an anode plate for an X-ray tube, the method including forming the anode plate having an outer edge and a center region, the anode plate including a plurality of slots disposed along the outer edge and extending toward the center region, each of the plurality of slots including a slot end, the method further comprising:

depositing slot termination material around at least a portion of the periphery of one or more of the slot ends, the slot termination material operable to reduce the tension stress or compression stress at the slot end.

12. The method of claim 11, wherein depositing slot termination material comprises depositing slot termination material around at least one-half of the periphery of one or more of the slot ends.

13. The method of claim 11, wherein depositing slot termination material comprises depositing slot termination material around substantially the entire periphery of one or more of the slot ends.

14. The method of claim 11, comprising forming slot termination material, between inner and outer radii of an inner ring at, and intersecting with, the slot end of one or more of the slots.

15. A method for manufacturing, for an X-ray tube, an anode plate having an outer edge and a center region, comprising:

providing a first hole in said plate at a location targeted for a slot end;

depositing slot termination material within the hole;

providing a second hole within the slot termination material, said second hole to form said slot end; and extending to thereby create a slot from said second hole to the outer edge of the anode plate, said material operable to reduce the tension stress or compression stress at said slot end.

16. A computer software product for manufacturing an anode plate for an X-ray tube, including forming the anode plate having an outer edge and a center region, the anode plate including a plurality of slots disposed along the outer edge and extending toward the center region, each of the plurality of slots including a slot end, said product having a computer readable medium embodying instructions executable by a processor to perform a plurality of acts, said plurality comprising:

depositing slot termination material around at least a portion of the periphery of one or more of the slot ends, the slot termination material operable to reduce the tension stress or compression stress at the slot end.

17. The computer software product of claim 16, wherein depositing slot termination material comprises depositing slot termination material around at least one-half of the periphery of one or more of the slot ends.

18. The computer software product of claim 16, wherein depositing slot termination material comprises depositing slot termination material around substantially the entire periphery of one or more of the slot ends.

19. The computer software product of claim 16, comprising forming slot termination material, between inner and outer radii of an inner ring at, and intersecting with, the slot end of one or more of the slots.

20. A plate having an outer edge, a center region, and a plurality of slots disposed along said outer edge and extending toward said center region, each of the central slot ends having a periphery, the plate comprising:

slot termination material, at least some of which is disposed around at least a portion of the periphery of one or more of said central slot ends, said slot termination material operable to, while said plate spins concurrently with heat being applied to an annular region radially outside said center region, reduce, at said one or more central slot ends about whose respective peripheries, or respective portions thereof, said slot termination material is disposed, compression stress.

21. The plate of claim 20, said stress being stress which would otherwise develop as a combined result of the spinning and the application of said heat during said spinning.

22. The plate of claim 20, said material being confined within, and between inner and outer radii of, an inner ring at the slot end of one or more of said slots, said ring being concentric with said plate.

23. The plate of claim 1, said material being confined within, and between inner and outer radii of, an inner ring at the slot end of one or more of said slots, said ring being concentric with said plate.

24. The plate of claim 23, an inner circumference of said ring being radially disposed at said slot end of one or more of said slots.

25. The method of claim 11, said material being confined within, and between inner and outer radii of, an inner ring at the slot end of one or more of said slots, said ring being concentric with said plate.

26. The method of claim 16, said material being confined within, and between inner and outer radii of, an inner ring at the slot end of one or more of said slots, said ring being concentric with said plate.

27. The plate of claim 4, said material filling and thereby defining said ring.

28. The plate of claim 1, said material forming said at least a portion of said periphery.

29. A computer software product for manufacturing, for an X-ray tube, an anode plate having an outer edge and a center region, said product having a computer readable medium embodying instructions executable by a processor to perform a plurality of acts, said plurality comprising:

providing a first hole in said plate at a location targeted for a slot end;

depositing slot termination material within the hole;

providing a second hole within the slot termination material, said second hole to form said slot end; and extending to thereby create a slot from said second hole to the outer edge of the anode plate, said material operable to reduce the tension stress or compression stress at said slot end.

* * * * *